US005770284A

United States Patent [19]

Logemann

[11] Patent Number: 5,770,284

[45] Date of Patent: Jun. 23, 1998

[54] TOWEL WITH INTEGRATED POCKET

[76] Inventor: Coe Leta Logemann, 10760 N. 156th St., Box 1, Bennington, Nebr. 68007

[21] Appl. No.: 796,286

[22] Filed: Feb. 7, 1997

[51] Int. Cl.[6] ..... B32B 3/04; B32B 3/06

[52] U.S. Cl. ..... 428/36.1; 428/99; 428/100; 428/124; 428/126; 428/131; 15/210.1; 383/4

[58] Field of Search ..... 428/99, 100, 124, 428/126, 131, 77, 36.1; 5/417; 15/209.1, 210.1; D6/608; 383/4, 38

[56] References Cited

U.S. PATENT DOCUMENTS

| | | | |
|---|---|---|---|
| D. 261,464 | 10/1981 | Smith | D6/265 |
| D. 312,371 | 11/1990 | Lawson | D6/595 |
| D. 316,791 | 5/1991 | Carney et al. | D6/595 |
| D. 330,140 | 10/1992 | Lerner | D6/608 |
| D. 339,710 | 9/1993 | Perna, Jr. | D6/608 |
| 2,968,825 | 1/1961 | Wetherby | 15/210.1 |
| 4,195,378 | 4/1980 | Parker | 5/419 |
| 4,991,978 | 2/1991 | Ostrowski | 383/4 |
| 5,018,229 | 5/1991 | Eberhart | 5/417 |
| 5,390,381 | 2/1995 | LaMantia | 5/417 |

*Primary Examiner*—Alexander Thomas
*Attorney, Agent, or Firm*—Adam H. Jacobs

[57] ABSTRACT

A towel having an integrated pocket includes a sheet of fabric material having two spaced-apart vertical folds formed in the sheet. The folds divide the sheet into first and second folded sections and an unfolded section intermediate the first and second folded sections. The first and second folded sections are connected to each other along at least part of the first and second folded sections adjacent the upper part of the sheet of fabric material. The first and second folded sections are connected to the unfolded section along a line extending generally horizontally and contacting the lower end of the connection of the first and second folded sections such that the sections cooperate to form an integrated pocket having an interior volume, a top opening and walls defined by the first and second folded sections and unfolded section. Finally, a closure device such as a hook and loop fastener is mounted on the sheet adjacent the top opening of the pocket for securing items within the pocket.

11 Claims, 5 Drawing Sheets

TOWEL WITH INTEGRATED POCKET

BACKGROUND OF THE INVENTION

1. Technical Field

This invention relates to sports towels and, more particularly, to a towel having an integrated pocket formed by folded connection of the towel sheet to itself such that no additional sections of material need be used to form the integrated pocket, the pocket being used for carrying of small items in the towel while a large portion of the towel remains for use for cleaning, drying, etc.

2. Description of the Prior Art

A standard golf bag include numerous pockets for holding various golf accessories, such as golf balls, golf tees and ball markers. The golfer will also have items which he or she does not wish to carry and instead desires to place in the golf bag or similar storage area. Such items could include wallets, keys, combs, etc. The problem with using the storage pockets of the golf bag for storing personal items such as those described above is that many golf bags include a limited number of pockets which are simultaneously being used for storage of golf balls, tees, and other golf accessories. Therefore, after the wallet or keys are placed in the pocket of the golf bag, the contents of the pocket are often shifted due to movement of the golf bag resulting in the keys or wallet falling underneath the other items stored in the pocket. Access to and removal of the personal items in the pocket is thus greatly inconvenienced. There is therefore a need for an easily accessible storage pocket for use with a golf bag.

Golf towels are commonly affixed to golf bags for a variety of purposes, including the cleaning of clubs after a shot has been taken, the wiping of hands and many other general cleaning purposes. The common golf towel includes a sheet of fabric material having two generally vertical folds formed therein such that the towel is folded over itself in thirds. A grommet extends through the three folded sections of the towel adjacent the top end of the towel, and a fastener such as a metal clip is used to extend through the grommet and attach the towel to the golf bag. Of course, there are numerous other types of towels used in connection with golf bags, some of which would include a single fold or no fold at all.

As was discussed previously, golf towels are commonly used with golf bags. It would be very convenient if the golf towel were to include an easily accessible pocket for storage of personal items such as those described above. There are several examples of towels including pockets shown in the prior art including Parker, U.S. Pat. No. 4,195,378, and Smith, U.S. Design Pat. No. 261,464. While these patents disclose towels used on the beach, it is at least conceivable that such towels could also be used as golf towels or the like. The major disadvantage found in these towels and in other such towels in the prior art is that the pockets are formed by the adding on of additional pocket-forming material which is then sewn onto the towel to form the pocket. In addition to being unsightly due to the distended nature of the pocket when filled, such pockets are inherently less structurally sound than a pocket formed integrally with the towel as a single unit. There is therefore a need for a towel having an integrated pocket which is not formed by the addition of material to the towel sheet itself.

In light of the common shape of the golf towel as described previously, the most convenient location for the item-receiving pocket would be adjacent the top end of the towel itself. Lerner, U.S. Design Pat. No. 330,140, discloses a towel having an inside pocket, and is shown in FIG. 7. However, the pocket is adjacent the lower end of the towel and is designed to wipe off golf clubs and balls, not to contain items for storage. There is therefore a need for a golf towel having an integrally-formed pocket adjacent the top end of the towel for providing easily accessible storage for items.

Of course, a towel having an integrated pocket formed therein could be used for numerous other sports, such as basketball, baseball, etc., or any sport for which a towel having a convenient pocket would be beneficial. For example, a person playing basketball could place their valuables such as a watch, wallet or keys in the pocket of the towel and still use the remainder of the towel for wiping his or her face, hands, or another suitable use. There is therefore a need for a towel having an integrated pocket which can be used for a variety of sporting activities.

Therefore, an object of the present invention is to provide a towel having an integrated pocket.

Another object of the present invention is to provide a towel having an integrated pocket, the towel including a sheet of fabric material with two spaced-apart folds being formed in the sheet, each of the folds extending generally vertically thereon such that the sheet includes first and second folded sections and an unfolded section between the first and second folded sections.

Another object of the present invention is to provide a towel having an integrated pocket in which the first and second folded sections are connected to one another along at least part of the first and second folded sections thus leaving the lower ends of the first and second folded sections free of connection.

Another object of the present invention is to provide a towel having an integrated pocket in which the first and second folded sections are connected to the unfolded section along a line extending generally parallel with the transverse axis of the sheet and generally contacting the lower end of the connection of the first and second folded sections such that the first and second folded sections and the unfolded section cooperate to form an integrated pocket having an interior volume, a top opening, and walls defined by the first and second folded sections and the unfolded section, the sheet thus being divided into an upper pocket section and lower towel section.

Another object of the present invention is to provide a closure device such as a velcro strip mounted on the sheet adjacent the top opening of the pocket, the closure device operative to releasably close the top opening of the pocket whereby the items within the integrated pocket may be secured there within.

Another object of the present invention is to provide a towel having an integrated pocket in which the pocket is structurally sound and capable of storing a broad range of items therein.

Another object of the present invention is to provide a towel having an integrated pocket on which a logo or the like may be affixed without disrupting the functionality of the towel.

Finally, an object of the present invention is to provide a towel having an integrated pocket which is simple and durable in construction and safe and efficient in use.

SUMMARY OF THE INVENTION

The present invention provides a towel having an integrated pocket, the towel including a sheet of fabric material having front and rear faces, a longitudinal axis and a transverse axis extending generally perpendicular to the longitudinal axis. Two spaced-apart folds are formed in the sheet, each of the folds extending generally parallel with the longitudinal axis such that the sheet includes first and second folded sections and an unfolded section between the first and second folded sections, the first and second folded sections extending generally parallel with and overlaying at least part of the unfolded section on the rear face thereof. The first and second folded sections each include a top edge, a fold edge and an outer side edge, the first folded section connected to the second folded section generally adjacent the outer side edges of the first and second folded sections along at least part of the first and second folded sections. The connection of the first and second folded sections includes a lower end below which the first and second folded sections are not connected to one another.

The first and second folded sections are connected to the unfolded section along a line extending generally parallel with the transverse axis of the sheet and generally contacting the lower end of the connection of the first and second folded sections such that the first and second folded sections and the unfolded section cooperate to form an integrated pocket having an interior volume, a top opening and walls defined by the first and second folded sections and unfolded section. The sheet is thus divided into an upper pocket section and a lower towel section. A closure device such as a hook and loop fastener is mounted on a sheet adjacent the top opening of the pocket, the closure device operative to releasably close the top opening of the integrated pocket whereby release of items held within the pocket can be prevented.

While the towel having an integrated pocket was described as including two spaced-apart folds, it is to be understood that the same basic procedure for formation of the pocket and lower towel section may be used with a single fold also, in which the single folded section would be connected to the unfolded section along the side edge and along a line extending generally across the fabric sheet to form the integrated pocket of the present invention.

Regardless of the specific formation technique used for the towel having an integrated pocket, it is expected that a grommet would be mounted in the towel adjacent the top of the upper pocket section and adjacent one of the two spaced-apart folds to allow a clip to be threaded thereto for connection to a golf bag. The grommet is not necessary, however, and in fact is undesirable if the towel is to be used for other sporting activities.

It is thus seen that the present invention provides numerous advantages over those pocketed towels found in the prior art. For example, the integral formation of the pocket using the towel fabric material itself for pocket formation leads to a substantially more structurally sound pocket construction. Furthermore, because the pocket is "within" the towel, there are no unsightly distentions or bulges presented by the pocket when items are retained therein. Additionally, because the lower portion of the towel is not used for pocket formation, the towel may continue to be used for its intended purpose of drying golf clubs, golf balls, hands, etc. Finally, because the towel of the present invention does not require additional materials to form the pocket, material expenses may be saved by the manufacturer, thus rendering the present invention more likely to produce a profit. It is thus seen that the present invention provides a substantial improvement over those towels found in the prior art.

DESCRIPTION OF THE PREFERRED EMBODIMENT

Figure 4:
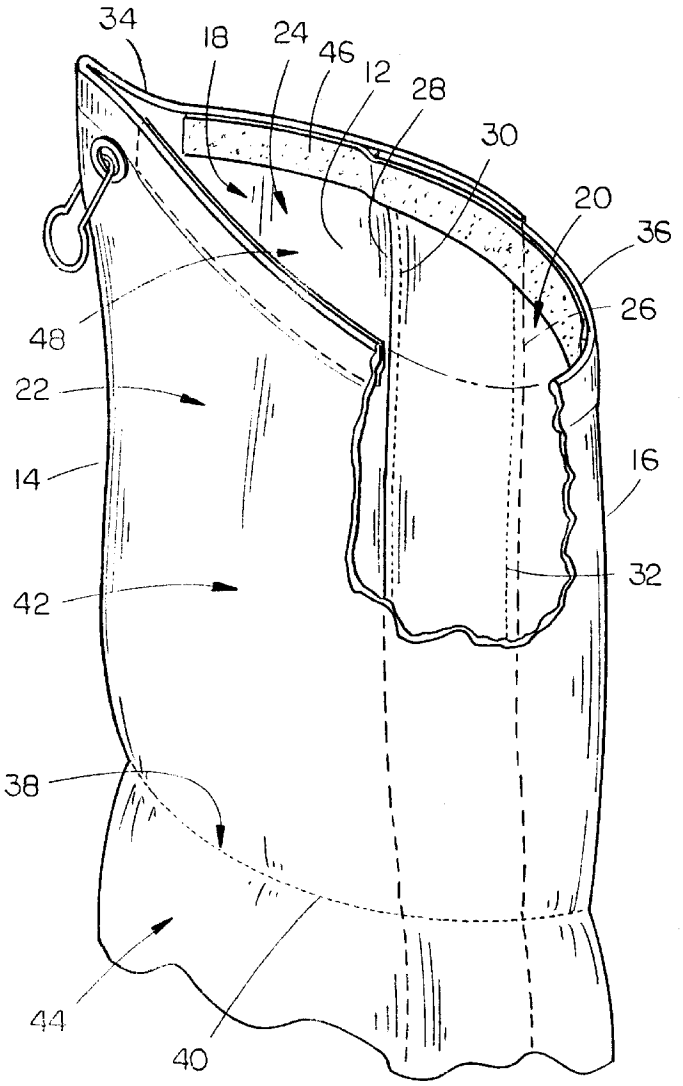
FIG. 4 is a partial detail perspective view of the integrated pocket section of the towel showing the stitching detail.
Figure 1:
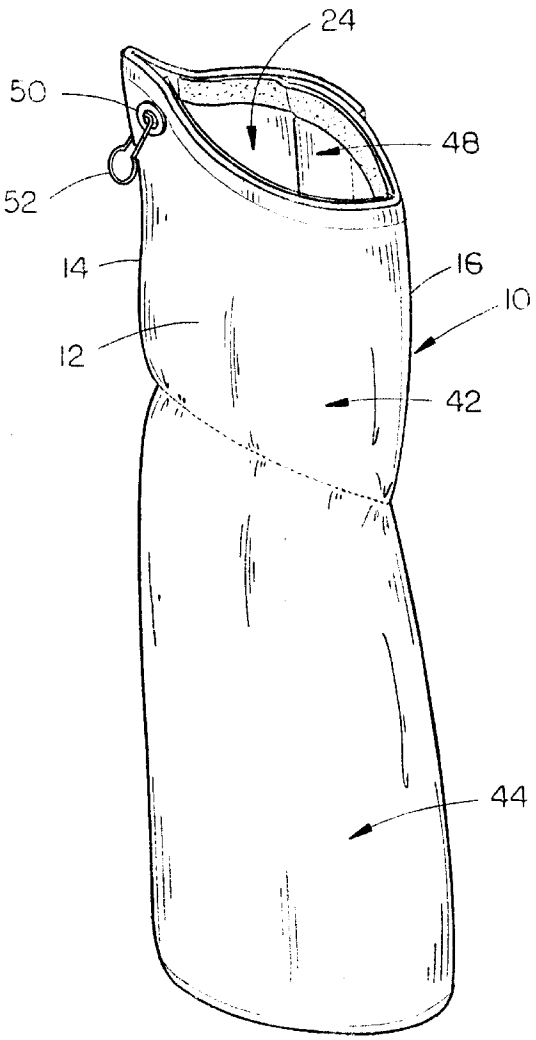
FIG. 1 is a perspective view of the towel of the present invention showing the pocket opened to receive items therein.

The towel with integrated pocket 10 of the present invention is shown best in FIGS. 1–5 as including sheet 12 of fabric material having two generally vertical spaced-apart folds 14 and 16 formed in the sheet 12. It is preferred that sheet 12 be constructed of a fabric material such as would commonly be used for a towel, although any appropriate material may be used so long as the towel characteristics of the invention are maintained. It is also preferred that sheet 12 be approximately 24 inches to 30 inches long and 12 to 20 inches in width, although these dimensions are not critical to the present invention and may be modified to suit the needs of the end user of the towel 10.

Folds 14 and 16 divide the sheet 12 into three sections, a first folded section 18, a second folded section 20 and an unfolded section 22 intermediate first and second folded sections 18 and 20. As shown in best in FIGS. 1–4, the first folded section 18 is connected to unfolded section 22 at fold 14 and the second unfolded section 20 is connected to the unfolded section 22 at second fold 16. In the preferred embodiment, first folded section 18 would have a width of approximately 3–6 inches, second folded section 20 would have a width of approximately 3–6 inches and unfolded section 22 would have a width of approximately 5–10 inches. Of course, these dimensions may be modified or changed as desired by the manufacturer of the towel with integrated pocket 10.

To this point, what has been described is similar to a standard golf towel. However, the unique aspects of the present invention will become apparent below. The integrated pocket 24 of the towel 10 is formed in the following manner. The first folded section 18 includes an outer side edge 26 which is the edge of the sheet 12 opposite fold 14 on first folded section 18. Likewise, second folded section 20 includes an outer side edge 28 which is the edge of sheet 12 opposite fold 16 on second folded section 20.

Figure 3:
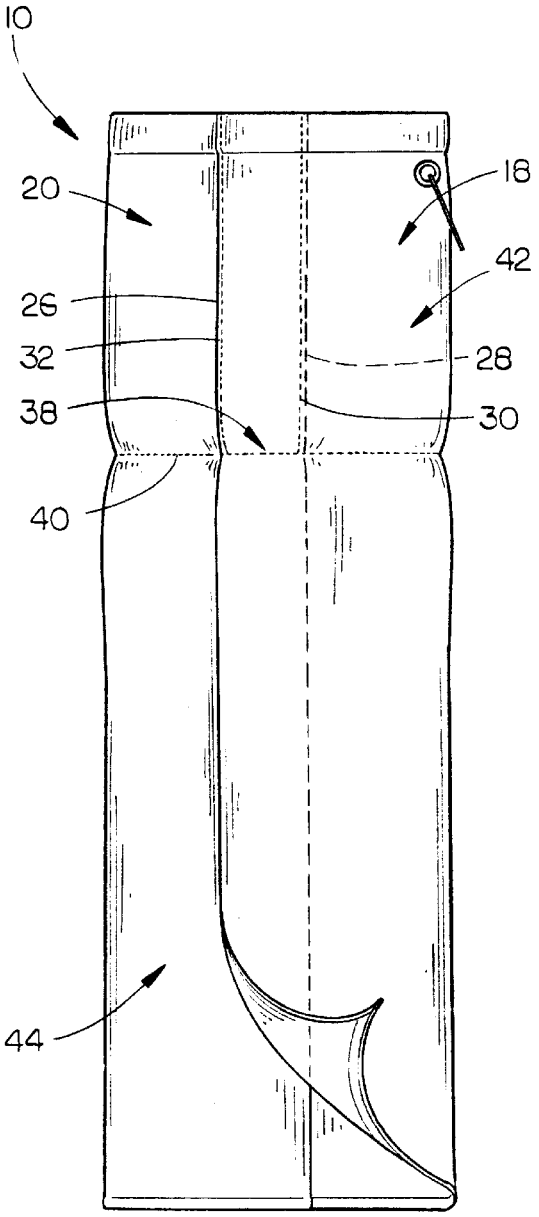
FIG. 3 is a rear elevational view of the towel showing the back stitching and double fold construction of the towel.

As shown best in FIGS. 3 and 4, first folded section 18 overlaps second folded section 20, the preferred overlap being between one-half and three inches although this dimension is not critical to the invention so long as first and second folded sections 18 and 20 can be connected to one another. First folded section 18 is then secured to second folded section 20 by connection stitching lines 30 and 32, the first stitching line 30 adjacent outer side edge 28 of second folded section 20 and the second connection stitching line 32 adjacent outer side edge 26 of first folded section 18. In the preferred embodiment, each of the stitching lines 30 and 32 would be a standard thread stitching for connecting two pieces of fabric material to one another. Of course, it is preferred that the stitching thread used be of a high strength and durability to ensure that the stitches will not pull out and unravel, which would result in the integrated pocket 24 falling apart.

FIG. 3 best shows that the stitching lines 30 and 32 extend from adjacent the top edges 34 and 36 of the first and second folded sections 18 and 20 downwards to the base 38 of integrated pocket 24. Base 38 of integrated pocket 24 is formed by a third line of stitching 40 which extends completely across the folded towel 10 along a generally horizontal line and connects the first folded section 18 and second folded section 20 to the unfolded section 22 and also connects first and second folded sections 18 and 20 along the overlap thereof. It is preferred that stitching line 40 be formed in a substantially similar manner as that described in connection with stitching lines 30 and 32 and may, in fact, include even more durable stitching thread to ensure pocket integrity. The stitching line 40 divides the towel 10 into an upper pocket section 42 and lower towel section 44. Although it is preferred that stitching line 40 be positioned on towel 10 approximately three-tenths of the length of towel 10 downwards from the top edge of the towel, it is to be understood that the precise positioning of the stitching line 40 is not critical to the invention so long as the stitching line 40 cooperates with stitching lines 30 and 32 to form a structurally sound integrated pocket 24.

Figure 5:
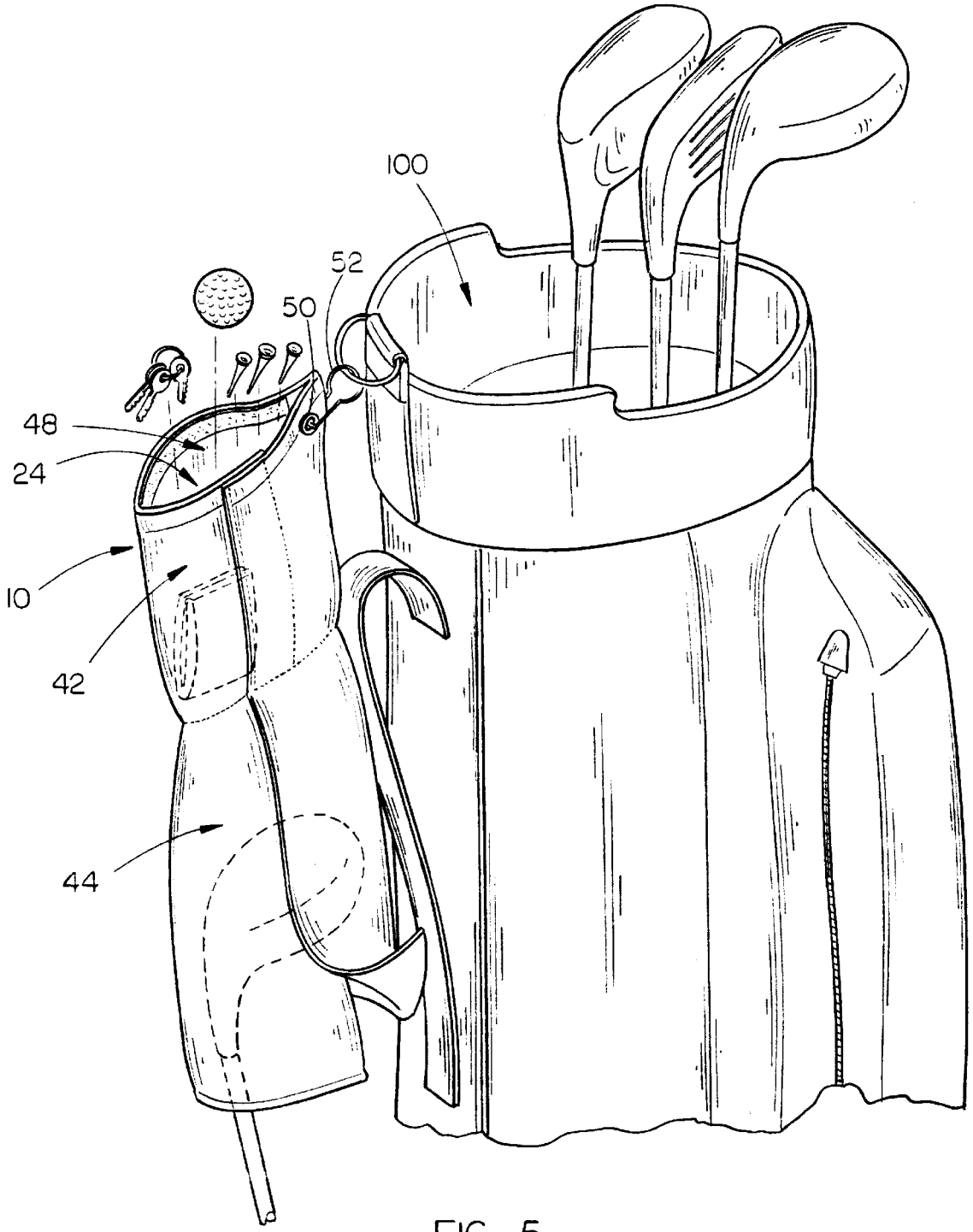
FIG. 5 is a perspective view of the towel connected to a golf bag by a clip, the pocket being open to receive items and the lower towel section being used to clean a golf club.

Once the sheet 12 of the fabric material has been stitched in the above-described manner, the towel having an integrated pocket 10 has been formed. To provide for closure of the integrated pocket 24, a closure device 46 is provided adjacent the top opening 48 of the integrated pocket 24 as shown best in FIGS. 1 and 4. It is preferred that the closure device 46 consist of a hook and loop fastener, with one section of the hook and loop fastener mounted on the unfolded section 22 and the other section of the hook and loop fastener mounted on the first and second folded sections 18 and 20, as shown in FIG. 4. Of course, any other suitable closure device may be substitute for the hook and loop fastener described above, including such items as snaps, zippers, etc. Also, for securing the towel 10 to a golf bag (as shown in FIG. 5), a grommet 50, which includes a central hole, is mounted in the towel 10 adjacent first fold 14 and extending between and connecting unfolded section 22 and first folded section 18. The grommet 50 may be positioned anywhere on towel 10 but is preferred that the grommet 50 be positioned so as not to interfere with accessing pocket 24 and therefore grommet 50 should be positioned adjacent either first fold 14 or second fold 16 near top opening 48 of pocket 24. Grommet 50 would preferably be a standard metal-type grommet. A metal clip 52 may be provided for securing the towel 10 to a golf bag 100 as show in FIG. 5, the metal clip 52 being of any standard type used in the art.

Figure 6:
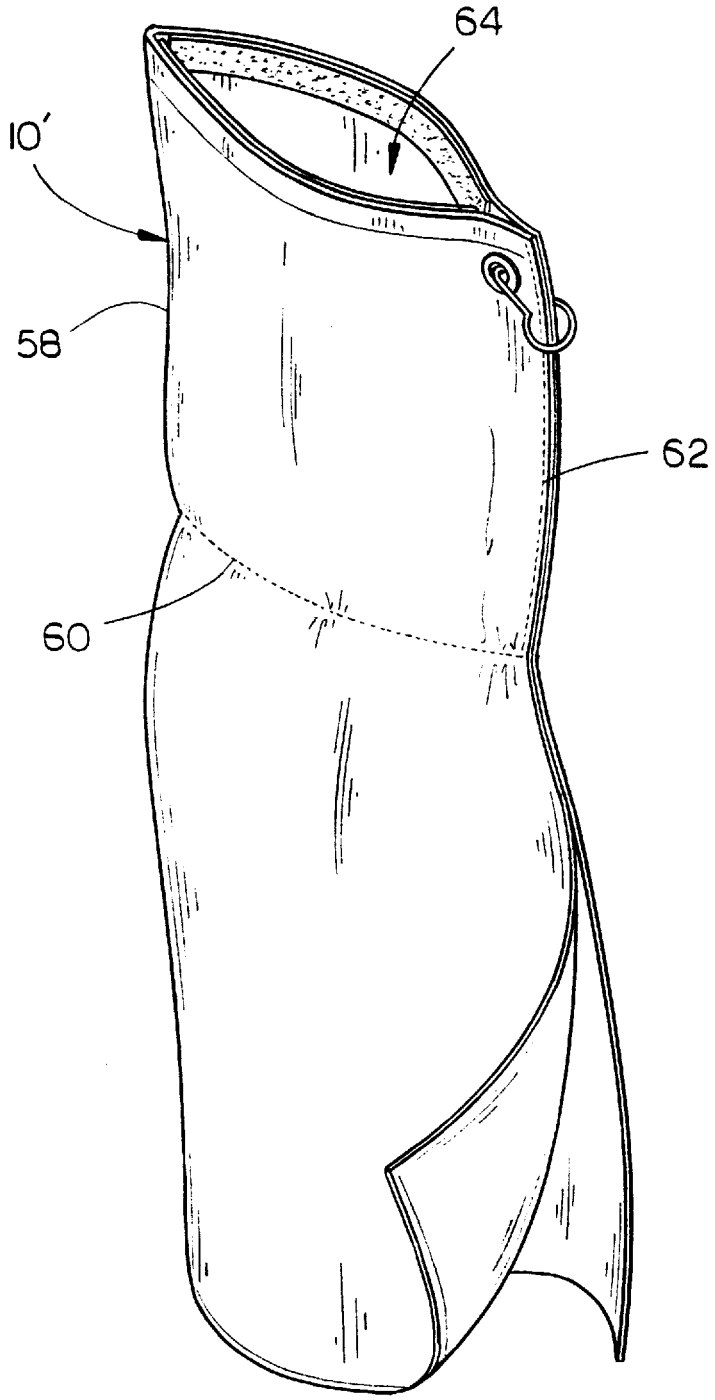
FIG. 6 is a perspective view of an alternative embodiment of the towel of the present invention with only a single fold in the towel.
Figure 7:
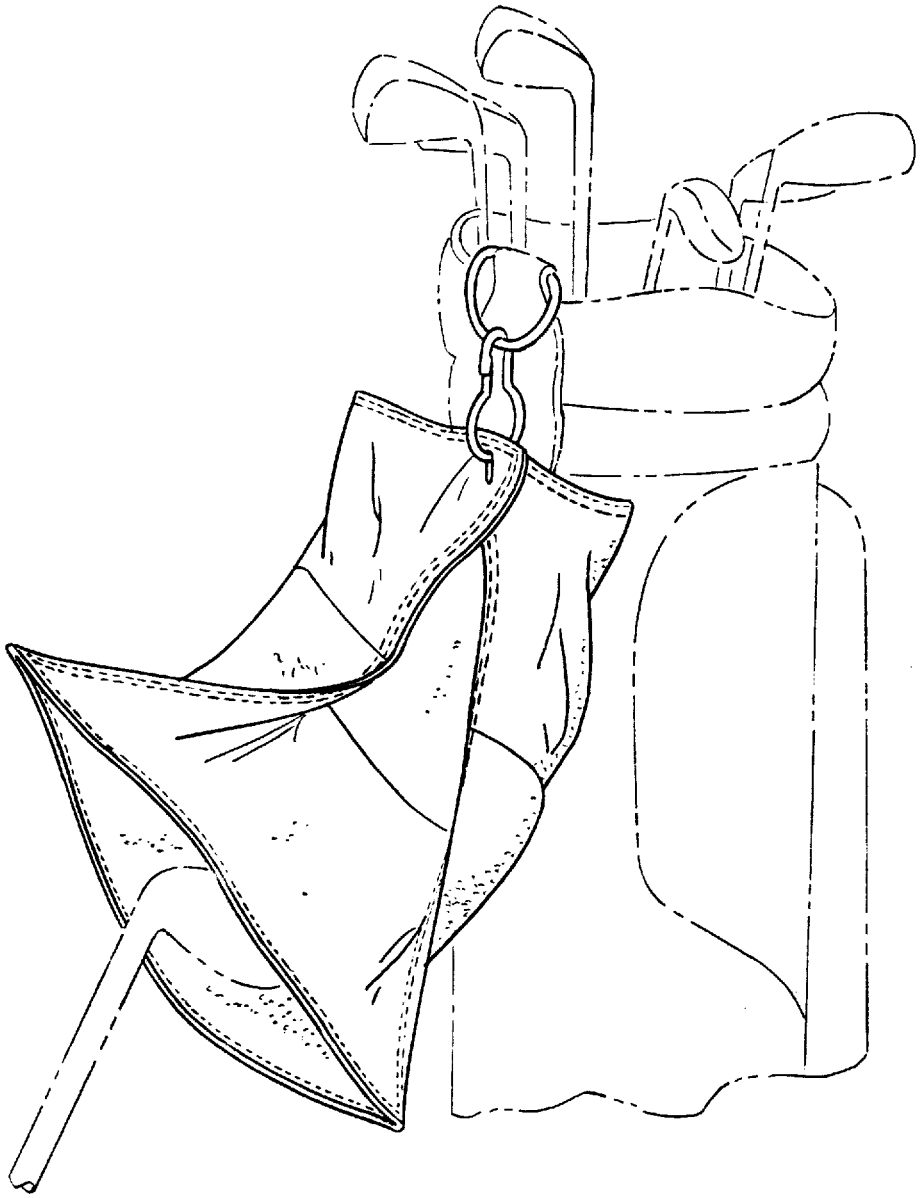
FIG. 7 (PRIOR ART)
FIG. 7 is an example of a towel found in the prior art.

While the above description pertains to a towel 10 including first and second folds 14 and 16 it is to be understood that the towel of the present invention may be formed having only a single fold as shown in FIG. 6. The alternative embodiment of the towel 10' shown in FIG. 6 would include a single fold 58 with the two sections of the towel being secured to one another along a base stitching line 60 and a side stitching line 62 to thus form pocket 64. The remaining elements of the towel 10' would be substantially similar to those described in connection with the embodiment shown in FIGS. 1–5.

Figure 2:
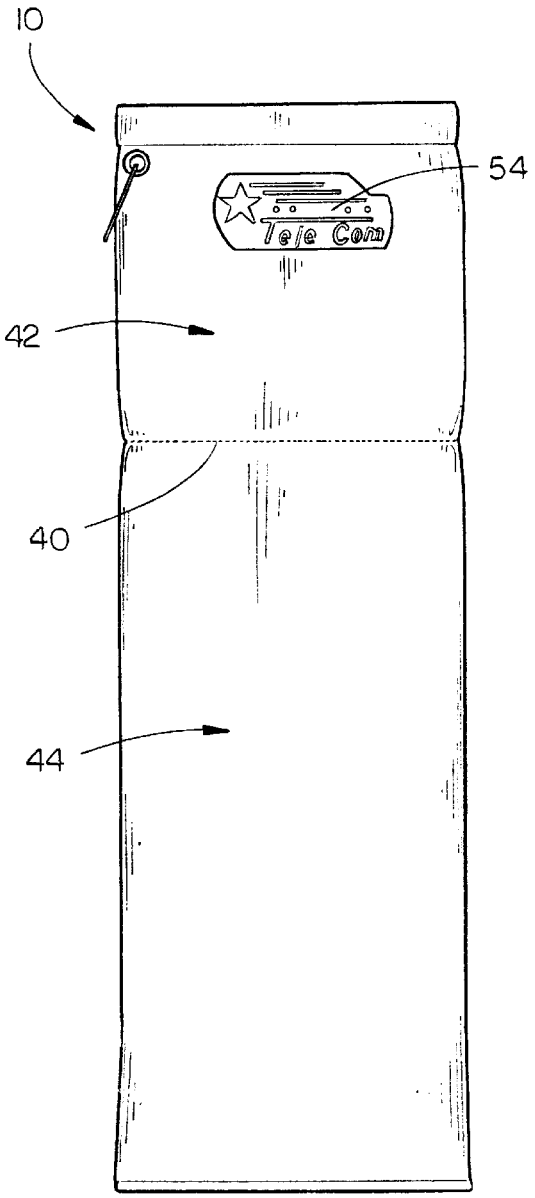
FIG. 2 is a front elevational view of the towel showing a logo in place on the pocket section thereof.

Regardless of which embodiment is constructed, one of the benefits of the towel 10 of the present invention is that it may easily have added to it a logo 54, as best shown in FIG. 2. It is expected that a virtually unlimited number of types of logos may be affixed to the towel 10 of the present invention on the upper pocket section 42, including business names, personal names, or any other design desired to be placed on the towel 10. As the placement of the logo 54 on upper pocket section 42 does not interfere with use of lower towel section 44 for the cleaning of golf accessories, the size and shape of the logo to be affixed to the upper pocket section 42 is only limited by the overall size of the upper pocket section 42 and not by any functional constraints.

It is to be understood that numerous additions, modifications and substitutions may be made to the towel 10 of the present invention which fall within the intended broad scope of the appended claims. For example, the dimensions and fold positions of the towel may be modified so long as the general characteristics of the invention are retained. Furthermore, the vertical position of the stitching line 40 may be modified to increase or decrease the pocket size desired, depending upon the intended use of the towel 10. Additionally, because the towel 10 includes an integrated pocket 24, the towel may be used for numerous other sporting activities, and, in fact, is useful in any situation where the presence of a towel is desired and the storage of personal items is needed. Finally, the use of different stitching materials, different closure devices and different fabric materials are all contemplated by the present invention.

There has thus been shown a towel having a integrated pocket which accomplishes at least all of the stated objectives.

I claim:

1. A towel having an integrated pocket, said towel comprising:

a sheet of fabric material having front and rear faces, a longitudinal axis and a transverse axis extending generally perpendicular to said longitudinal axis;

two spaced-apart folds being formed in said sheet, each of said folds extending generally parallel with said longitudinal axis such that said sheet includes first and second folded sections and an unfolded section between said first and second folded sections, said first and second folded sections extending generally parallel with and overlaying at least part of said unfolded section on said rear face of said sheet;

said first and second folded sections each having a top edge, a fold edge and an outer side edge, said first folded section connected to said second folded section generally adjacent said outer side edges of said first and second folded sections along at least part of said first and second folded sections, said connection having a lower end below which said first and second folded sections are free of connection to one another;

said first and second folded sections connected to said unfolded section along a line extending generally parallel with said transverse axis of said sheet and generally contacting said lower end of said connection of said first and second folded sections such that said first and second folded sections and said unfolded section cooperate to form an integrated pocket having an interior volume, a top opening and walls defined by said first and second folded sections and said unfolded section, said sheet being divided into an upper pocket section and a lower towel section; and closure means mounted on said sheet adjacent said top opening of said pocket, said closure means operative to releasably close said top opening of said pocket whereby release of items held within said pocket is prevented.

2. The towel of claim 1 wherein said fabric material is selected from the group consisting of terrycloth, cotton, polyester, rayon and nylon fabrics.

3. The towel of claim 1 wherein said connection of said first and second folded sections to one another and said connection of said first and second folded sections to said unfolded section are thread sewn connections used for connection of two fabric sections to one another.

4. The towel of claim 1 wherein said upper pocket section is smaller than said lower towel section whereby said lower towel section is efficiently usable for cleaning of golf accessories.

5. The towel of claim 1 wherein said closure means is selected from the group consisting of hook and loop fasteners, snaps, zippers and zip-lock fasteners.

6. The towel of claim 1 further comprising a flattened generally toroidal grommet mounted in said towel generally adjacent one of said folds and extending between and connecting said unfolded section and one of said first and second folded sections, said grommet including a central hole through which a clip is extendable for connection to a golf bag, said grommet positioned on said towel such that said integrated pocket is accessible free of interference from said grommet.

7. A towel having an integrated pocket, said towel comprising:

a sheet of fabric material;

at least one generally vertical fold being formed in said sheet such that said sheet includes at least one folded section and an unfolded section, said folded section extending generally parallel with and overlaying at least part of said unfolded section;

said folded section having a top edge, a fold edge and an outer side edge, said folded section connected to said unfolded section generally adjacent said outer side edge of said folded section along at least part of said folded section, said connection having a lower end below which said folded section and said unfolded section are free of connection to one another;

said folded section further connected to said unfolded section along a line extending across said sheet of fabric material and generally contacting said lower end of said connection of said folded section and said unfolded section such that said folded section and said unfolded section cooperate to form an integrated pocket having an interior volume, a top opening and walls defined by said folded section and said unfolded section, said sheet being divided into an upper pocket section and a lower towel section; and closure means mounted on said sheet adjacent said top opening of said pocket, said closure means operative to releasably close said top opening of said pocket whereby release of items held within said pocket is prevented.

8. The towel of claim 7 wherein said fabric material is selected from the group consisting of terrycloth, cotton, polyester, rayon and nylon fabrics.

9. The towel of claim 7 wherein said connection of said folded section to said unfolded section is a thread sewn connection used for connection of two fabric sections to one another.

10. The towel of claim 7 wherein said closure means is selected from the group consisting of hook and loop fasteners, snaps, zippers and zip-lock fasteners.

11. The towel of claim 7 further comprising a flattened generally toroidal grommet mounted in said towel generally adjacent one of said folds and extending between and connecting said unfolded section and one of said first and second folded sections, said grommet including a central hole through which a clip is extendable for connection to a golf bag, said grommet positioned on said towel such that said integrated pocket is accessible free of interference from said grommet.

* * * * *